US007944431B2

(12) United States Patent
Tanaka et al.

(10) Patent No.: US 7,944,431 B2
(45) Date of Patent: May 17, 2011

(54) TRANSMISSIVE DISPLAY DEVICE

(75) Inventors: Hiroshi Tanaka, Soraku-gun (JP); Tsuyoshi Muramatsu, Nara (JP); Takashi Morisue, Nara (JP); Atsushi Aoki, Nara (JP); Manabu Yumoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 820 days.

(21) Appl. No.: 11/936,211

(22) Filed: Nov. 7, 2007

(65) Prior Publication Data

US 2008/0111784 A1 May 15, 2008

(30) Foreign Application Priority Data

Nov. 13, 2006 (JP) ..... 2006-307125

(51) Int. Cl.
*G09G 3/36* (2006.01)

(52) U.S. Cl. ..... 345/102; 345/87; 345/98; 349/61

(58) Field of Classification Search ..... 345/87–100, 345/102; 349/56, 61, 62, 65
See application file for complete search history.

(56) References Cited

U.S. PATENT DOCUMENTS

| | | | | |
|---|---|---|---|---|
| 6,448,951 | B1 * | 9/2002 | Sakaguchi et al. | 345/88 |
| 7,312,779 | B1 * | 12/2007 | Blevins | 345/102 |
| 2006/0038770 | A1 * | 2/2006 | Burkholder | 345/102 |
| 2006/0125771 | A1 * | 6/2006 | Inuzuka et al. | 345/102 |
| 2006/0232544 | A1 * | 10/2006 | Sakashita | 345/102 |
| 2006/0262078 | A1 * | 11/2006 | Inuzuka et al. | 345/102 |
| 2007/0057940 | A1 * | 3/2007 | Petschnigg et al. | 345/419 |
| 2007/0152949 | A1 * | 7/2007 | Sakai | 345/102 |
| 2007/0222740 | A1 * | 9/2007 | Hanada | 345/102 |
| 2008/0084509 | A1 | 4/2008 | Inoue et al. | |

FOREIGN PATENT DOCUMENTS

| | | |
|---|---|---|
| JP | 2006-047594 | 2/2006 |
| JP | 2008-52131 A | 3/2008 |
| JP | 2008-116914 A | 5/2008 |

* cited by examiner

*Primary Examiner* — Kimnhung Nguyen
(74) *Attorney, Agent, or Firm* — Nixon & Vanderhye, P.C.

(57) ABSTRACT

Each of image data sorted so as to correspond to divided areas respectively is stored in an in-area image memory. A maximum luminance extracting section extracts the maximum luminance value therefrom and records it onto the maximum luminance storage section. In accordance with the maximum luminance value that is thus stored in the maximum luminance storage section and that each of the areas has, a BL candidate value calculating section and a BL luminance difference adjusting section determine an emitted-light luminance in a target area such that a difference between the backlight luminance in the target area and the backlight luminance in its adjacent area is not more than a tolerance value.

6 Claims, 11 Drawing Sheets

FIG. 3 (a)

| R | G | B | R | G | B | R | G | B | R | G | B |
|---|---|---|---|---|---|---|---|---|---|---|---|
| 128 | 64 | 0 | 100 | 34 | 20 | 10 | 10 | 60 | 10 | 10 | 40 |
| 10 | 10 | 60 | 10 | 10 | 40 | 10 | 10 | 40 | 10 | 10 | 40 |

FIG. 3 (b)

| | | | | | | | | | | | |
|---|---|---|---|---|---|---|---|---|---|---|---|
| 255 | 128 | 0 | 199 | 68 | 40 | 43 | 43 | 255 | 43 | 43 | 170 |
| 43 | 43 | 255 | 43 | 43 | 170 | 64 | 64 | 255 | 64 | 64 | 255 |

| | |
|---|---|
| 128(AREA A) | 60(AREA B) |
| 60(AREA C) | 40(AREA D) |

FIG. 4 (a)

| | | | | |
|---|---|---|---|---|
| 4 | 8 | 1 | 5 | 5 |
| 4 | 1 | 2 | 7 | 4 |
| 1 | 5 | 1 | 3 | 2 |
| 0 | 8 | 6 | 2 | 7 |
| 3 | 6 | 2 | 4 | 5 |

FIG. 4 (b)

| | | | | | |
|---|---|---|---|---|---|
| 0 | 4 | 8 | 6 | 5 | 5 |
| 0 | 4 | 2 | 2 | 7 | 5 |
| 0 | 1 | 5 | 3 | 3 | 2 |
| 0 | 0 | 8 | 6 | 4 | 7 |
| 0 | 3 | 6 | 4 | 4 | 5 |

FIG. 4 (c)

| | | | | | |
|---|---|---|---|---|---|
| 6 | 8 | 6 | 5 | 5 | 0 |
| 4 | 3 | 5 | 7 | 5 | 0 |
| 3 | 5 | 3 | 3 | 2 | 0 |
| 6 | 8 | 6 | 5 | 7 | 0 |
| 4 | 6 | 4 | 4 | 5 | 0 |

FIG. 4 (d)

| | | | | |
|---|---|---|---|---|
| 0 | 0 | 0 | 0 | 0 |
| 6 | 8 | 6 | 5 | 5 |
| 4 | 6 | 5 | 7 | 5 |
| 3 | 5 | 3 | 5 | 3 |
| 6 | 8 | 6 | 5 | 7 |
| 4 | 6 | 4 | 4 | 5 |

FIG. 4 (e)

| | | | | |
|---|---|---|---|---|
| 6 | 8 | 6 | 5 | 5 |
| 4 | 6 | 5 | 7 | 5 |
| 4 | 6 | 4 | 5 | 5 |
| 6 | 8 | 6 | 5 | 7 |
| 4 | 6 | 4 | 4 | 5 |
| 0 | 0 | 0 | 0 | 0 |

FIG. 5 (a)

| | | | | |
|---|---|---|---|---|
| 4 | 8 | 1 | 5 | 5 |
| 4 | 1 | 2 | 7 | 4 |
| 1 | 5 | 1 | 3 | 2 |
| 0 | 8 | 6 | 2 | 7 |
| 3 | 6 | 2 | 4 | 5 |

FIG. 5 (b)

| | | | | | |
|---|---|---|---|---|---|
| | 0 | 0 | 0 | 0 | 0 |
| 0 | 4 | 8 | 6 | 5 | 5 |
| 0 | 4 | 6 | 4 | 7 | 5 |
| 0 | 2 | 5 | 3 | 5 | 3 |
| 0 | 0 | 8 | 6 | 4 | 7 |
| 0 | 3 | 6 | 4 | 4 | 5 |

FIG. 5 (c)

| | | | | | |
|---|---|---|---|---|---|
| 6 | 8 | 6 | 5 | 5 | 0 |
| 4 | 6 | 5 | 7 | 5 | 0 |
| 4 | 6 | 4 | 5 | 5 | 0 |
| 6 | 8 | 6 | 5 | 7 | 0 |
| 4 | 6 | 4 | 4 | 5 | 0 |
| 0 | 0 | 0 | 0 | 0 | |

FIG. 6 (a)
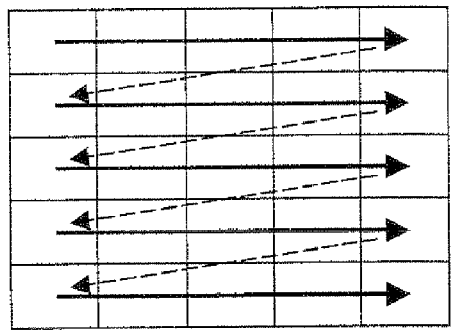
FIG. 6 (b)
| | | |
|---|---|---|
| COMPARATIVE PIXEL | COMPARATIVE PIXEL | COMPARATIVE PIXEL |
| COMPARATIVE PIXEL | TARGET PIXEL | |
FIG. 6 (c)
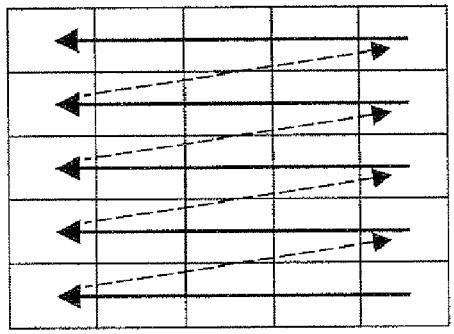
FIG. 6 (d)
| | | |
|---|---|---|
| | TARGET PIXEL | COMPARATIVE PIXEL |
| COMPARATIVE PIXEL | COMPARATIVE PIXEL | COMPARATIVE PIXEL |

TRANSMISSIVE DISPLAY DEVICE

This Nonprovisional application claims priority under 35 U.S.C. §119(a) on Patent Application No. 2006/307125 filed in Japan on Nov. 13, 2006, the entire contents of which are hereby incorporated by reference.

FIELD OF THE INVENTION

The present invention relates to a transmissive display device such as a liquid crystal display device, particularly to a transmissive display device using an active backlight capable of controlling luminance of emitted light.

BACKGROUND

There are various types of color display in practical use. Thin-shaped displays are classified into (i) a self-emission type display such as a PDP (plasma display panel) and (ii) a non-emission type display such as an LCD (liquid crystal display). A transmissive LCD is well known as the LCD, which is a non-emission type display. The transmissive LCD is configured such that a backlight is provided behind a liquid crystal panel.

FIG. 8 is a cross sectional view illustrating a general structure of such a transmissive LCD. In the transmissive LCD, a backlight 110 is provided behind a liquid crystal panel 100. The liquid crystal panel 100 includes a pair of transparent substrates 101 and 102, a liquid crystal layer 103 provided therebetween, and polarizing plates 104 and 105 sandwiching the transparent substrates 101 and 102. Further, a color filter 106 is provided in the liquid crystal panel 100, thereby attaining color display.

Although not illustrated, electrode layers and alignment films are provided on the inner sides of the transparent substrates 101 and 102. By controlling an applied voltage to the liquid crystal layer 103, a transmission amount of light through the liquid crystal panel 100 is controlled for each pixel. In other words, in the transmissive LCD, the liquid crystal panel 100 controls the transmission amount of light irradiated from the backlight 110, thus carrying out display control.

Mainly employed for the backlight 110 is a backlight emitting white light having respective wavelengths of R, G, and B, which are necessary for color display. The backlight 110 and the color filter 106 work together to adjust each of transmittances for the R, G, and B light beams of the light, thereby arbitrarily setting luminance and hue in each pixel. For the backlight 110, a backlight including light sources for R, G, and B can be used.

For example, in the LCD, transmittance for output display information is controlled by a shutter operation of the liquid crystal panel 100 provided with the color filter 106 having portions corresponding to R, G, and B existing in each pixel. Specifically, the transmittance is controlled in a range from 0% to 100% by performing predetermined steps. Consider a case of allowing light from the light backlight 110 to pass therethrough by 100%. In this case, ideally, the light irradiated from the backlight is outputted with intact intensities in its relevant color components, so luminance is the maximum. Meanwhile, when the transmittance is set to be 0%, black display is attained. As such, in such a normal transmissive LCD carrying out display control through the shutter operation of the liquid crystal panel 100, the backlight 110 keeps on emitting light with the constant luminance.

Because the backlight 110 thus keeps on emitting light with the constant luminance in the above structure, the backlight 110 consumes a lot of electric power. Specifically, even while the LCD displays dark images on its screen as a whole, the backlight 110 emits light with the maximum luminance. Most of the light thus emitted is blocked as a result of the shutter operation of the liquid crystal panel 100. As such, a large amount of light from the backlight 110 is wasted while electric power consumption in the backlight 110 is large. The electric power consumption of the backlight makes up a large proportion of electric power consumption in the LCD. Hence, such a waste is a very great loss for the entire system.

In order to solve the problem, Japanese Unexamined Patent Publication "Tokukai 2006-47594 (published on Feb. 16, 2006)" discloses a technique of reducing electric power consumption of backlights. In the technique, luminance adjustable active backlights are used to carry out display control of an LCD (luminance control) by controlling transmittance in the liquid crystal panel and luminance in the active backlight. FIG. 9 illustrates a schematic structure of the LCD system described in Japanese Unexamined Patent Publication "Tokukai 2006-47594 (published on Feb. 16, 2006)".

The LCD shown in FIG. 9 is configured such that a CPU 202 sends image information, stored in a RAM 201, to an active BL (backlight) controller 203. The active BL controller 203 uses liquid crystal drivers 204 and 205 so as to control transmittance in the liquid crystal panel 210, and uses backlight luminance adjusting sections 206R, 206G, and 206B so as to control respective luminances of light from a red backlight 207R, a green backlight 207G, and a blue backlight 207B. Thus, the red backlight 207R, the green backlight 207G, and the blue backlight 207B in the LCD are active backlights each capable of adjusting the luminance of light therefrom.

With reference to FIG. 10(*a*) to FIG. 10(*c*), the following explains an effect of reducing electric power consumption of the backlights in Japanese Unexamined Patent Publication "Tokukai 2006-47594 (published on Feb. 16, 2006)". For ease of explanation, the description below exemplifies display control over an area made up of 4 pixels, each of which has color components of R, G, and B.

First, consider a case of carrying out a display operation with 256 grayscale (0 to 255) in accordance with display data shown in FIG. 10(*a*). Here, while no luminance control is carried out with respect to the backlights, each of the backlights emits light with the maximum luminance (255), and only the transmittance of the liquid crystal panel is controlled in accordance with the display data (see FIG. 10(*b*)).

Meanwhile, consider a case of carrying out display control by using the active backlights as shown in FIG. 10(*c*). In this case, the luminance of light from the backlights is controlled to coincide with the maximum luminance value in the display data. In the case where the red, green, and blue backlights are provided as such, each of the red, green, and blue backlights controls the luminance of light therefrom such that the luminance thereof coincides with the maximum luminance value of a corresponding color component of the display data. In accordance with the luminance of each backlight, the transmittance of the liquid crystal panel is adjusted. For example, in FIG. 10(*c*), in order to display a red image at a display luminance of 128, the luminance of light from the red backlight is set at 128 and the transmittance of a relevant pixel in the liquid crystal panel is set at 255 (100%). In this way, the display luminance of 128 (=luminance of 128×transmittance of 100%) is attained. In the meanwhile, in FIG. 10(*b*), in order to display a red image at a display luminance of 128, the luminance of light from the red backlight is set at 255 and the transmittance of a relevant pixel in the liquid crystal panel is set at 128 (50%). Now, compare the cases of FIG. 10(*c*) and FIG. 10(*b*). The luminance of light from the backlight in Figure 10(*c*) is 128, which is reduced from the luminance of 255 in the case of FIG. 10(*b*).

In the transmissive display device using such an active backlight, the luminance of light from each active backlight can be controlled with the entire screen regarded as one area. However, by carrying out backlight luminance control for a plurality of divided areas of the screen individually, it is possible to enhance the effect of reducing electric power consumption.

However, such backlight luminance control for each of the divided areas of the display screen suffers from such a problem that boundaries between display areas are likely to be viewed and recognized due to light leaking from adjacent display areas. The following explains such a problem with reference to FIG. 11(*a*) to FIG. 11(*c*).

First, consider a case where a display operation is carried out in two adjacent display areas in accordance with display data shown in FIG. 11(*a*). For ease of explanation, assume that each of the two adjacent display areas is made up of three pixels in this case.

FIG. 11(*b*) illustrates the luminance of the backlight and the transmittance of each pixel, both of which are controlled in accordance with the display data shown in FIG. 11(*a*). In this case, light beams irradiated from light emitting areas of the backlight are not completely parallel to one another, so there is leaking light (illustrated by a solid arrow in FIG. 11(*b*)) going from one light emitting area to adjacent display areas. Such leaking light undesirably increases display luminances of pixels located in the vicinity of the boundary of the display areas as shown in FIG. 11(*c*). As a result, when the luminances in pixels adjacent to each other with a boundary of display areas therebetween should be the same, the actual display luminances therein become different from each other, with the result that a viewer is likely to view and recognize the boundary due to the difference of luminances.

SUMMARY

The technology disclosed herein is made in light of the foregoing problem, and its object is to realize a transmissive display device, which controls the luminance of a backlight based on a plurality of divided areas of a display screen, is capable of alleviating such a problem that a viewer recognizes the boundary of adjacent display areas, and is therefore capable of displaying an image' with a desired luminance.

To achieve the object, a transmissive display device according to the technology disclosed herein includes: a backlight, including a plurality of light emitting areas capable of controlling emitted-light luminances respectively; a transmission control panel for controlling transmittances for the light emitted from the backlight for display; emitted-light luminance setting means for setting emitted-light luminances in the light emitting areas of the backlight respectively; and transmittance setting means for setting the transmittances in pixels of the transmission control panel in accordance with the emitted-light luminances in the light emitting areas of the backlight respectively, the emitted-light luminance setting means setting the emitted-light luminances such that either a difference between emitted-light luminances in adjacent emitting areas of the backlight or a ratio of the emitted-light luminances in the adjacent light emitting areas is not more than a tolerance value.

According to the above configuration, the emitted-light luminance setting means sets the emitted-light luminances in the light emitting areas of the backlight such that a difference between the emitted-light luminances in adjacent light emitting areas or a ratio of the emitted-light luminances in the adjacent light emitting areas is not more than the tolerance value. This reduces an undesired difference between the luminances of the adjacent areas due to leakage of light, thereby restraining such a problem that a boundary between the areas is viewed and recognized.

Additional objects, features, and strengths of the technology disclosed herein will be made clear by the description below. Further, the advantages of the technology disclosed herein will be evident from the following explanation in reference to the drawings.

BRIEF DESCRIPTION OF THE DRAWINGS

FIG. 3(*a*) is a diagram illustrating an exemplary display data used in the liquid crystal display device shown in FIG. 1. FIG. 3(*b*) is a diagram illustrating a transmittance in a liquid crystal and a luminance of a backlight in cases where a display operation is carried out in accordance with the exemplary display data.

Each of FIG. 4(*a*) to FIG. 4(*e*) is a diagram illustrating procedures of correcting luminance values of a backlight.

Each of FIG. 5(*a*) to FIG. 5(*c*) is a diagram illustrating procedures of correcting luminance values of the backlight.

FIG. 6 are diagrams illustrating procedures of correcting luminance values of the backlight. Each of FIG. 6(*a*) and FIG. 6(*c*) is a diagram illustrating an order of shifting a target area. Each of FIG. 6(*b*) and FIG. 6(*d*) is a diagram illustrating a relation among the target area and comparative areas.

Figure 7:
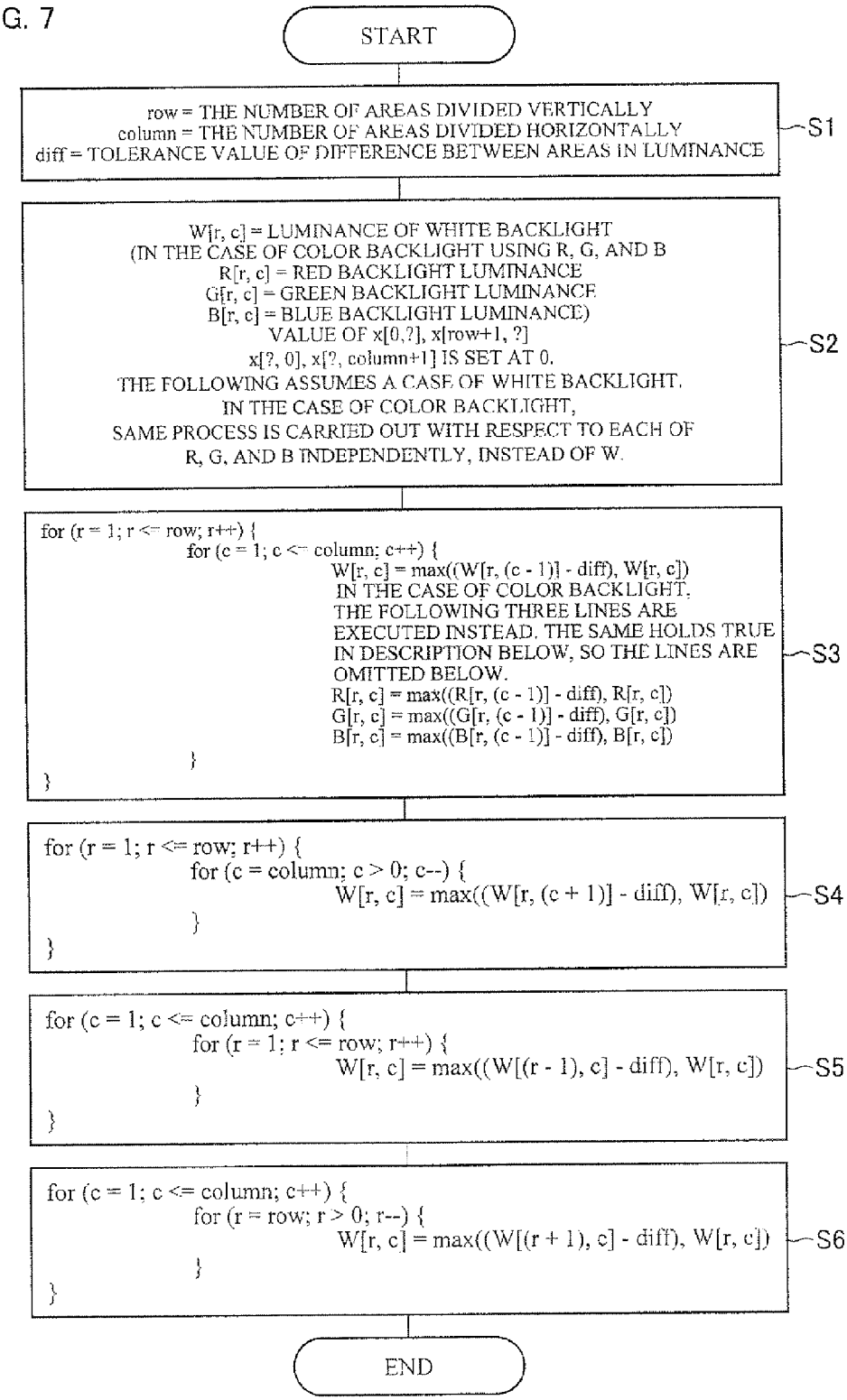

FIG. 7 is a flowchart illustrating an algorithm.

Figure 8:
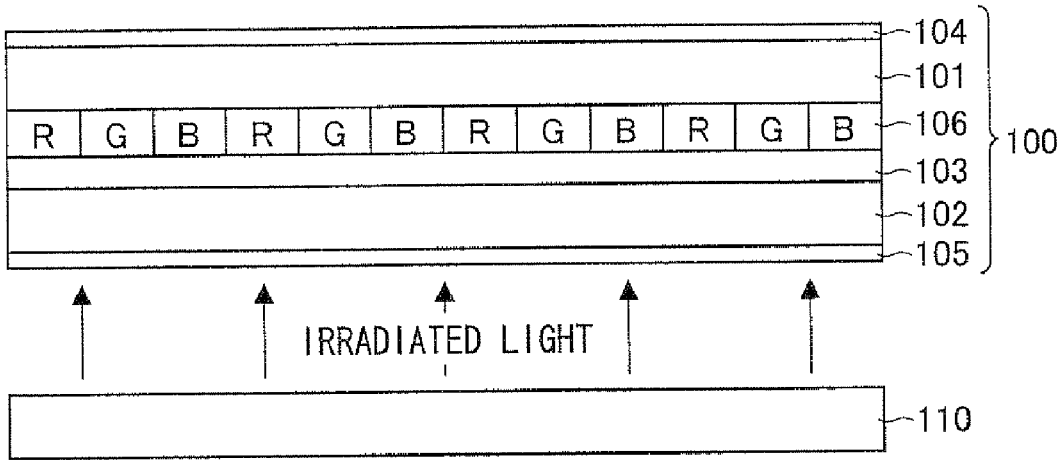
FIG. 8 (PRIOR ART)

FIG. 8 is a cross sectional view illustrating a general structure of a transmissive liquid crystal display device.

Figure 9:
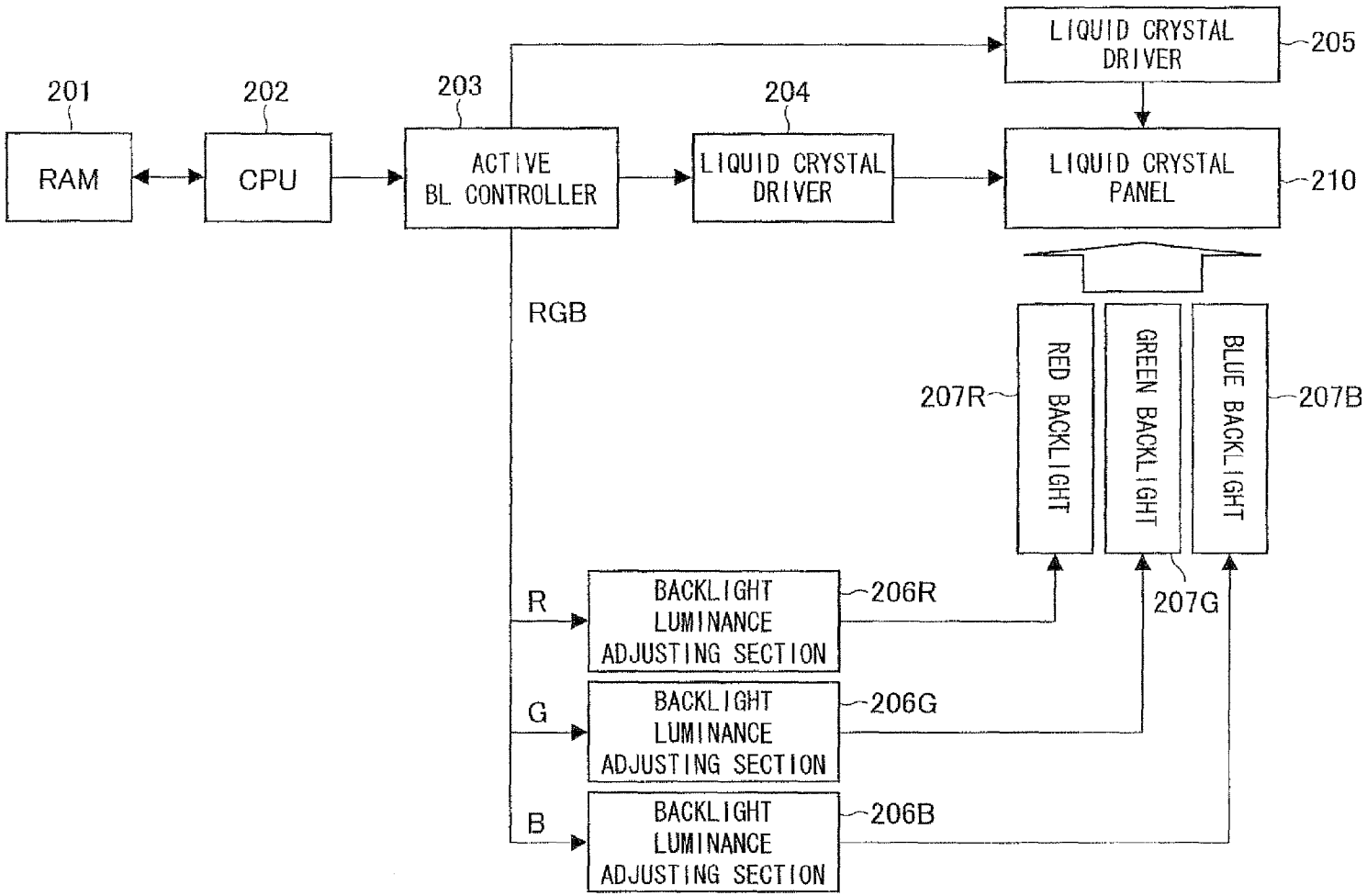
FIG. 9 (PRIOR ART)

FIG. 9 is a block diagram illustrating configurations of main parts of a conventional liquid crystal display device using a active backlight.

Figure 10:
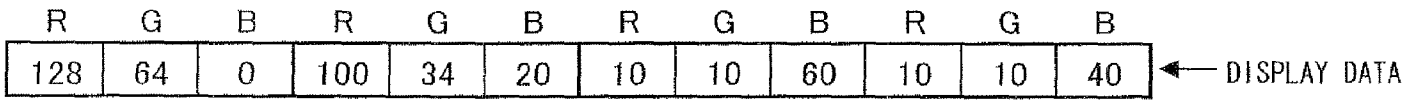
FIG. 10 (a) (PRIOR ART)
Figure 10:
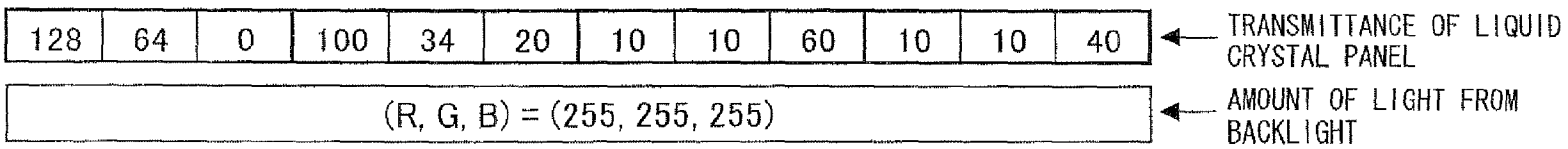
FIG. 10 (b) (PRIOR ART)
Figure 10:
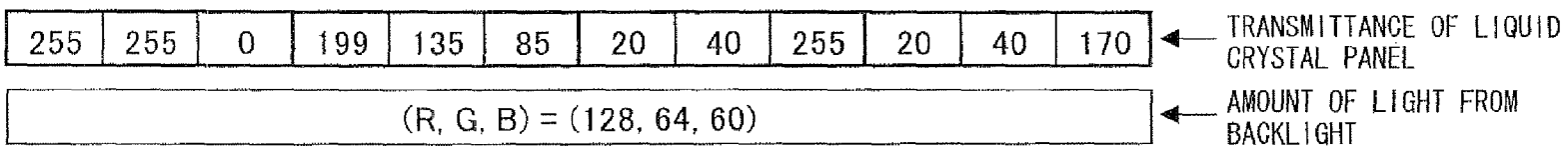
FIG. 10 (c) (PRIOR ART)

FIG. 10(*a*) is a diagram illustrating exemplary display data used in a liquid crystal display device. FIG. 10(*b*) is a diagram illustrating the transmittance of a liquid crystal and the luminance of a backlight in cases where a liquid crystal display device that does not use an active backlight carries out an display operation in accordance with the display data. FIG. 10(*c*) is a diagram illustrating the transmittance of a liquid crystal and the luminance of a backlight in cases where a liquid crystal display device using an active backlight carries out an display operation in accordance with the display data.

Figure 11:
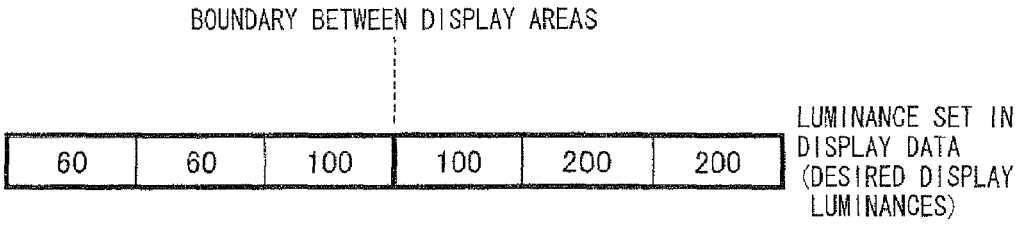
FIG. 11 (a) (PRIOR ART)
Figure 11:
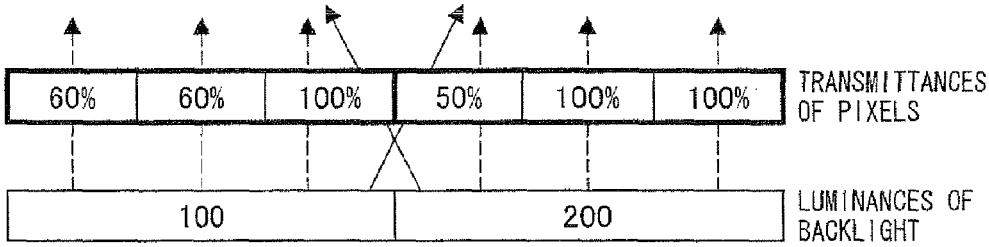
FIG. 11 (b) (PRIOR ART)
Figure 11:
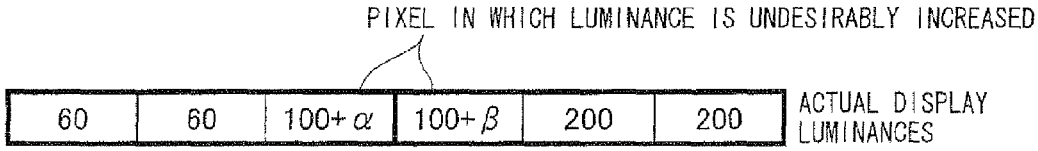
FIG. 11 (c) (PRIOR ART)

Each of FIG. 11(*a*) to FIG. 11(*c*) is a diagram illustrating that luminances in adjacent display areas are increased due to leakage of light therebetween in a liquid crystal display device using an active backlight.

DESCRIPTION OF THE EMBODIMENTS

One embodiment of the technology disclosed herein will be described with reference to FIG. 1 to FIG. 7. Explained first is the schematic structure of a liquid crystal display device according to the present embodiment.

Figure 2:
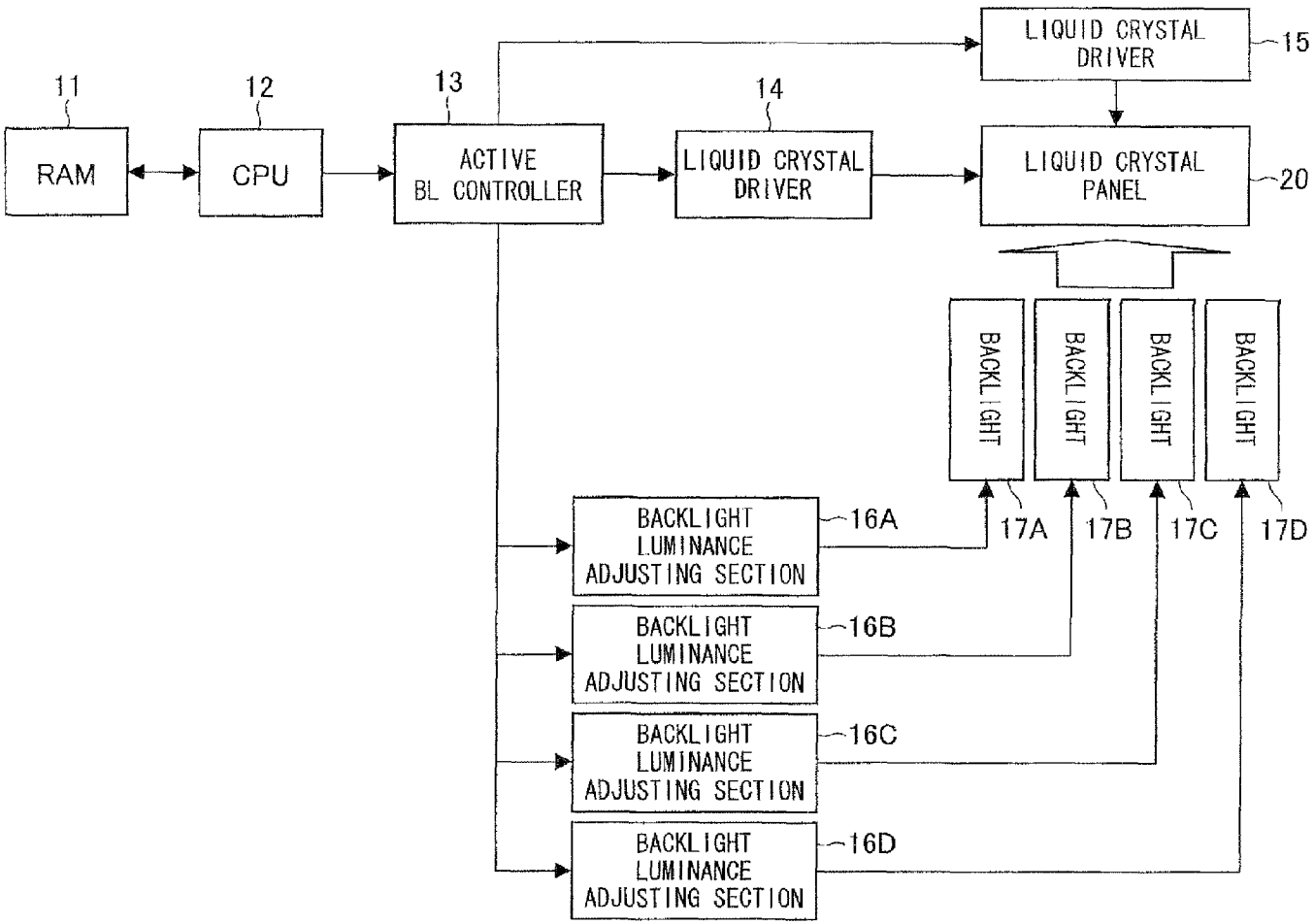
FIG. 2 is a block diagram illustrating configurations of main parts of the liquid crystal display device of the embodiment of the technology disclosed herein.

FIG. 2 illustrates the liquid crystal display device, which includes a RAM 11, a CPU 12, an active BL controller 13, liquid crystal drivers 14 and 15, a liquid crystal panel 20, backlight luminance adjusting sections 16, and a backlight 17.

The liquid crystal display device is configured such that the CPU 12 sends image information, stored in the RAM 11, to the active BL (backlight) controller 13. The active BL controller 13 uses the liquid crystal drivers 14 and 15 to control transmittance in the liquid crystal panel 20, and uses the backlight luminance adjusting sections 16 to control the luminance of the backlight 17.

Here, the backlight 17 is a backlight emitting white light including the wavelengths of the three colors: R, G, and B. The backlight 17 includes four light emitting areas 17A to 17D so as to correspond to display areas obtained by dividing the display screen of the liquid crystal panel 20 in four, respectively. Further, the backlight 17 is an active backlight capable of adjusting the luminances of light beams from the light emitting areas 17A to 17D individually. The backlight luminance adjusting sections 16 are made up of backlight luminance adjusting sections 16A to 16D, which control the luminances of the emitted light beams respectively.

In other words, in the liquid crystal display device according to the present embodiment, the display screen of the liquid crystal panel 20 is divided into the plurality of areas, and the transmittances in the liquid crystal panel and the luminances of the light beams from the active backlight are controlled for each of the areas thus divided. In accordance with the control, the liquid crystal display device carries out display control.

With reference to FIG. 3(*a*) and FIG. 3(*b*), the following explains how the liquid crystal display device shown in FIG. 2 allows an effect of reducing electric power consumption of the backlight. For ease of explanation, the description below exemplifies display control over a display screen made up of 8 pixels, each of which includes color components of R, G, and B.

First, consider a case where display grayscale is 256 grayscale (0 to 255) and a display operation is carried out in accordance with display data shown in FIG. 3(*a*). Now, assume that the display screen is divided into four areas with two pixels regarded as one area. Specifically, in FIG. 3(*a*) and FIG. 3(*b*), it is regarded that two pixels in the upper left constitute an area A, two pixels in the upper right constitute an area B, two pixels in the lower left constitute an area C, and two pixels in the lower right constitute an area D.

In the display control, the luminances of light beams from the backlight are controlled so as to coincide with the maximum luminance values corresponding to the areas A to D and set in the display data, respectively, as shown in FIG. 3(*b*). In accordance with the luminances of the light beams from the backlight, the transmittances in the liquid crystal panel are adjusted. For example, in FIG. 3 (*b*), the maximum luminance value in the area A is R=128, so the luminance of a light beam from the backlight for the area A is set at 128. The transmittance of each of the pixels in the area A is determined so as to attain a display luminance desired when the luminance of the light beam from the backlight is 128. For the areas B to C, each of the luminance values of the light beams from the backlight is set at 60. For the area D, the luminance value of the light beam from the backlight is set at 40.

As such, even when the maximum luminance value of the entire screen of the liquid crystal display device is 128, only the backlight luminance value for the area A including the pixels corresponding to the maximum luminance value is set at 128, and the luminance values of the other areas B to D are set at values lower than 128. This makes it possible to further reduce the electric power consumption of the backlight as compared with the structure in which the luminance of the active backlight is controlled with the entire screen regarded as one area, as described in Japanese Unexamined Patent Publication "Tokukai 2006-47594 (published on Feb. 16, 2006)".

In the above explanation, the display screen is divided into four areas, but the number of divided areas is not limited to this but may be arbitrary in the present invention. Further, the sizes and shapes of the divided areas may be all the same or different from each other.

Exemplified in the above explanation is the liquid crystal display device including the backlight provided with the white light source. With such a structure, it is possible to collectively adjust the respective luminances of the colors of R, G, and B, thereby simplifying the structure of the backlight. However, the present invention is not limited to this, and the liquid crystal display device may employ a structure using a backlight provided with light sources of the colors of R, G, and B.

In the example shown in FIG. 3, the luminance of an image to be displayed on the right pixel of the area C and the luminance of an image to be displayed on the left pixel of the area D are the same, but the backlight luminances and control values for the transmittances of the pixels are different. Accordingly, the boundary between the area C and the area D is likely to be viewed by a viewer. The boundary becomes more noticeable as a difference between the luminances in adjacent areas is larger, and becomes less noticeable as a difference therebetween is smaller.

In view of this, the liquid crystal display device according to the present embodiment is configured to correct the backlight luminances in the adjacent areas such that the difference between the backlight luminances therein is equal to or smaller than a predetermined value. This is a feature of the liquid crystal display device. The following explains a way of correcting the backlight luminances, with reference to FIG. 4(*a*) to FIG. 4(*e*).

FIG. 4(*a*) illustrates an example of respective uncorrected backlight luminance values in areas obtained by dividing one screen into 25 (=5×5). Each of the backlight luminance values for the areas shown in FIG. 4(*a*) is a luminance value required in displaying an image in a pixel of its corresponding area with the maximum luminance, is set at a value minimally required, but does not take into consideration a difference between the luminances of adjacent areas. Assume that the backlight luminance value for each of the areas is adjustable in a range from 0 to 8 in FIG. 4(*a*) to FIG. 4(*e*).

In the example shown in FIG. 4(*a*), the difference between the backlight luminances of the adjacent areas are not taken into consideration. In the example, the difference is 7 at maximum between (i) an area of the first row and the second column and (ii) an area of the second row and the second column. The following explanation exemplifies a case where the difference between the backlight luminances in the adjacent areas is corrected with a tolerance value of 2.

In FIG. 4(*b*), the backlight luminance value for a target area is compared with the backlight luminance value for a comparative area positioned on the left side with respect to the target area. In this case, when the backlight luminance value of the target area is smaller than the backlight luminance value of the comparative area by 3 or more, the backlight luminance value of the target area is corrected (the backlight luminance value of the target area is increased) such that the difference therebetween becomes 2. Specifically speaking, a value obtained by subtracting 2 from the backlight luminance value of the comparative area positioned on the left side with respect to the target area is compared with the backlight luminance value of the target area, and a larger one of the backlight luminance values thus compared is adopted as a corrected backlight luminance value for the target area. For example, assume that an area of the first row and third column is the target area. In this case, a value obtained by subtracting 2 from the backlight luminance value of a comparative area positioned on the left side with respect to the area is 6. The backlight luminance value for the target area before correction is 1, so the corrected backlight luminance value for the target area is set at 6.

FIG. 4(*b*) illustrates a result of correction in cases where the aforesaid process is carried out by shifting the target area from left to right one after another in each of the rows. Assume that a column of areas each having a backlight luminance value of 0 virtually exist in the left side with respect to the area of the first column. As a result of such a process, the backlight luminance value for each of the areas is never smaller than the backlight luminance value for an area positioned on the left side with respect to the area by 3 or more.

FIG. 4(*c*) illustrates a result of correction in cases where the same process is carried out by shifting the target area from right to left one after another in each of the rows. In this case, a value obtained by subtracting 2 from the backlight luminance value for the comparative area positioned on the right side with respect to the target area is compared with the backlight luminance value for the target area, and a larger one of the backlight luminance values thus compared is adopted as a corrected backlight luminance value for the target area. In this process, it is assumed that a column of areas each having a backlight luminance value of 0 virtually exist in the right side with respect to the area of the fifth row. As a result of such a process, the backlight luminance value of each of the areas is never smaller than the backlight luminance value of an area positioned on the right side with respect to the area by 3 or more.

FIG. 4(*d*) illustrates a result of correction in cases where the same process is carried out by shifting the target area from upward to downward one after another in each of the rows. FIG. 4(*e*) illustrates a result of correction in cases where the same process is carried out by shifting the target area from downward to upward one after another in each of the rows. As a result of these processes, the backlight luminance value for each of the areas is never smaller than the backlight luminance value of an area positioned on the upward side or downward side with respect to the area by 3 or more.

As a result of the processes shown in FIG. 4(*b*) to FIG. 4(*e*), each of the areas never has a backlight luminance value smaller than the backlight luminance value of its adjacent area (area positioned on any one of the upward side, downward side, left side, or right side with respect to the area) by 3 or more. In other words, the processes shown in FIG. 4(*b*) to FIG. 4(*e*) are to (i) extract an area having a backlight luminance value whose difference from the backlight luminance value of its adjacent area is not less than the tolerance value, and (ii) increase the backlight luminance value of the extracted area such that the difference between the backlight luminances of the areas adjacent to each other is not more than the tolerance value.

Note that the processes shown in FIG. 4(*b*) to FIG. 4(*e*) do not need to be done in this order but may be carried out in an arbitrary order. Further, as shown in FIG. 5(*a*) to FIG. 5(*c*), it is possible to simultaneously carry out (i) either one of the processes in which the target area is shifted in the direction of row (the process shown in FIG. 4(*b*) or FIG. 4(*c*)), and (ii) either one of the processes in which the target area is shifted in the direction of column (the process shown in FIG. 4(*d*) or FIG. 4(*e*)).

In each of the examples shown in FIG. 4 and FIG. 5, the difference between the backlight luminances for the adjacent areas meeting with their sides in contact is corrected to be the tolerance value or less. Instead, the difference between the backlight luminances for adjacent areas meeting with their corners in contact may be corrected to be equal to the tolerance value or less. Such a case will be exemplified and explained with reference to FIG. 6(*a*) to FIG. 6(*d*).

Also in this case, it is assumed that one screen is divided into 25 (=5×5) areas. In the first process, the target area is shifted from the area of the first row and first column to the area of the fifth row and fifth column as shown in FIG. 6(*a*). In this case, a relation between the target area and comparative areas are shown in FIG. 6(*b*). In the second process, the target area is shifted from the area of the fifth row and fifth column to the area of the first row and first column as shown in FIG. 6(*c*). In this case, a relation between the target area and comparative areas are shown in FIG. 6(*d*).

In the case where the difference between the backlight luminances for the adjacent areas meeting with their corners in contact are thus taken into consideration, the tolerance value of the difference between the backlight luminances for the adjacent areas meeting with their corners in contact may be same as or different from the tolerance value of the difference between the backlight luminances for the adjacent areas meeting with their sides in contact. For example, the tolerance value of the difference between the backlight luminances for the adjacent areas meeting with their side in contact can be 2, whereas the tolerance value of the difference between the backlight luminances for the adjacent areas meeting with their corners in contact can be 3.

The tolerance value of the difference between the backlight luminance values for the adjacent areas is not limited to the difference between the luminances of the backlight as with the above case, but may be set in accordance with a relative ratio of luminance values.

Further, the backlight luminance value of the area of the fourth row and first column among the backlight luminance values shown in FIG. 4(*a*) is 0 before being corrected, but is corrected to be 6 because its adjacent area of the fourth row and second column has a backlight luminance value of 8. Before the correction, the backlight luminance is 0, so all the pixels in the area carries out black display. In each of the pixels carrying out black display, a black image is supposed to be displayed irrespective of transmittance of the liquid crystal when the luminance of the backlight is 0, but it is preferable to set the transmittance of the liquid crystal at 0 in consideration of light leaking from the surrounding areas. As long as the transmittance of the liquid crystal is set at 0, the difference between the luminance in this area and the luminance in its adjacent area has substantially no influence while the backlight luminance in this area is 0. Hence, for reducing electric power consumption, the uncorrected backlight luminance of a certain area is 0, the backlight luminance in the area may be never corrected and may be unchanged to be 0 in the end.

Figure 1:
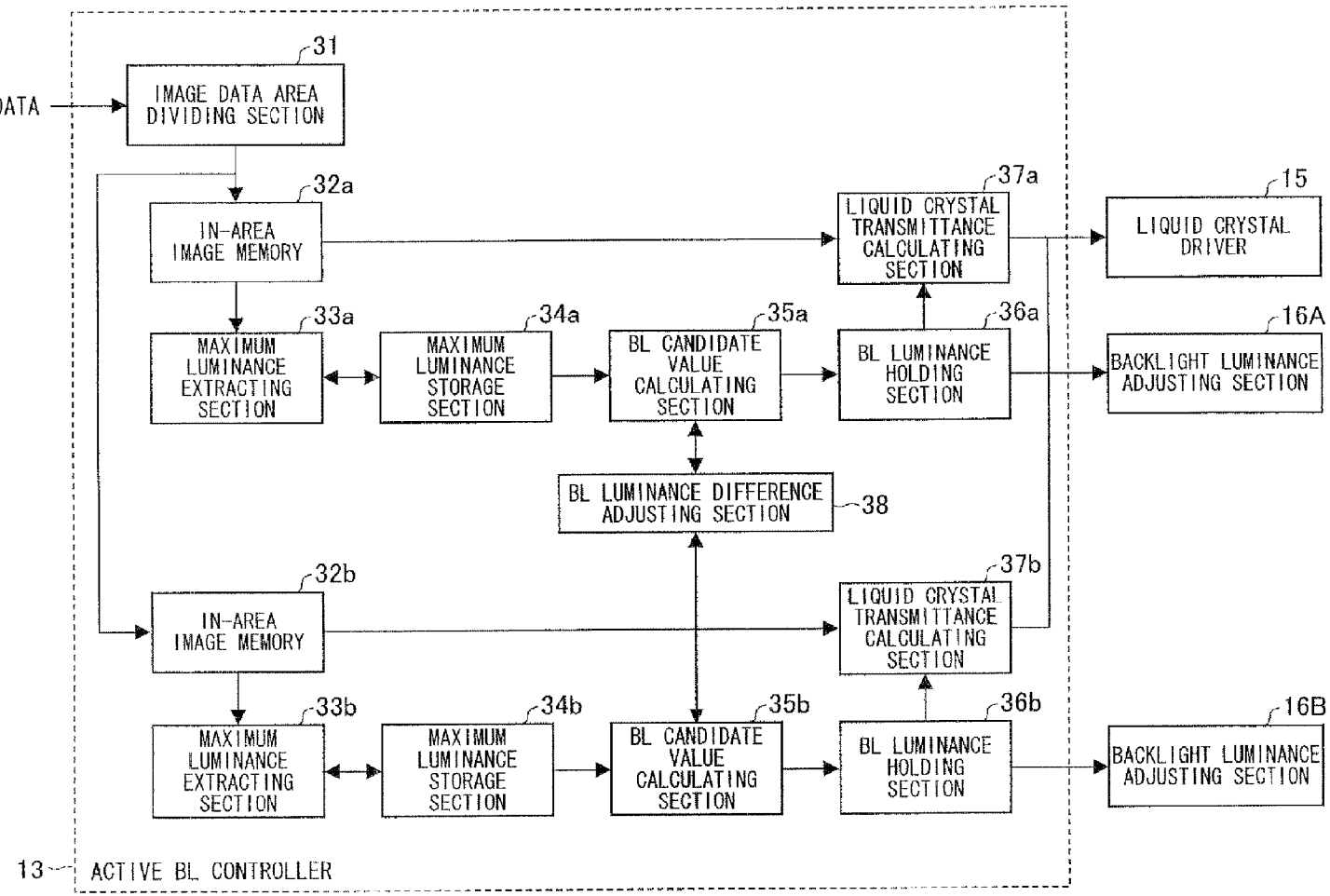
FIG. 1 is a block diagram illustrating configurations of main parts of an active BL controller of a liquid crystal display device of an embodiment of the technology disclosed herein.

In the liquid crystal display device shown in FIG. 2, the transmittance of the liquid crystal panel and the luminance of the active backlight are set by the active BL controller 13. FIG. 1 illustrates an example of the configuration of the active BL controller 13.

As shown in FIG. 1, the active BL controller 13 includes: an image data area dividing section 31, in-area image memories 32*a* and 32*b*, maximum luminance extracting sections 33*a* and 33*b*, maximum luminance storage sections 34*a* and 34*b*, BL candidate value calculating sections 35*a* and 35*b*, BL luminance holding sections 36*a* and 36*b*, liquid crystal transmittance calculating sections 37*a* and 37*b*, and a BL luminance difference adjusting section 38.

The image data area dividing section 31 carries out a process of allocating input image data to the areas obtained by dividing the display screen of the liquid crystal panel 20. For ease of explanation, assume that the display screen is divided into two areas. The image data, which has been divided so as to correspond to the areas respectively, are stored in the in-area image memories 32*a* and 32*b* respectively. Processes by the function sections rendered the suffix "a" and processes by the function sections rendered the suffix "b" are the same apart from areas targeted for the processes. Hence, the following only explains the function sections rendered the suffix "a".

The maximum luminance extracting section 33*a* extracts the maximum luminance value from the luminance values of all the pixel data stored in the in-area image memory 32*a*. The maximum luminance value thus extracted is recorded onto the maximum luminance storage section 34*a*.

In accordance with the maximum luminance value thus recorded onto each of the maximum luminance storage sections 34*a* and 34*b*, the BL candidate value calculating sections 35*a* and 35*b*, and the BL luminance difference adjusting section 38 determine the luminance of emitted light from the backlight for an area corresponding to the maximum luminance value.

Specifically, the maximum luminance values having been recorded onto the maximum luminance storage sections 34*a* and 34*b* are first written in the BL candidate value calculating sections 35*a* and 35*b*. The BL luminance difference adjusting section 38 reads out the maximum luminance values recorded onto the BL candidate value calculating sections 35*a* and 35*b* from the maximum luminance storage sections 34*a* and 34*b* respectively, and then compares and corrects the luminance values in accordance with, e.g., the processes shown in FIG. 4 or FIG. 5. For example, consider a case of carrying out the process shown in FIG. 4 (*b*). In this case, the BL luminance difference adjusting section 38 reads out the luminance value of a target area and the luminance values of comparative areas from a corresponding BL candidate value calculating section. When the BL luminance difference adjusting section 38 corrects the luminance value of the target area in accordance with the result of comparison, the BL luminance difference adjusting section 38 feeds back the corrected luminance value to the BL candidate value calculating section. When receiving the feedback of the corrected luminance value, the BL candidate value calculating section replaces the stored luminance value with the corrected luminance value. The luminance value stored in each of the BL candidate value calculating sections 35*a* and 35*b* as a result of the processes carried out in accordance with all the aforesaid procedures is determined as the backlight luminance value to be used finally.

The above explanation deals with the case where the backlight emits white light. However, the present invention is applicable to a case where the backlight is not provided with a white light source but is a color backlight provided with respective light sources for the colors of R, G, and B. In this case, the aforesaid processes may be carried out with respect to the respective luminance values of the R, G, and B light sources of the backlight. For example, consider a case where the light sources of the three colors of R, G, and B in the backlight are controlled independently. In this case, it is necessary to control differences between adjacent areas in the luminances of the light sources of the backlight for these three colors. For the control, the luminance values of the same colors are compared between the adjacent areas such that the luminance of the light of the backlight for each of the adjacent areas falls within a tolerable range. For example, in cases where a difference is set at, e.g., not more than 10 between the luminance value of each of R, G, and B of a first area having luminance values of (R, G, B)=(100, 100, 100) and the luminance value of each of R, G, and B of a second area adjacent to the first area and having luminance values of (R, G, B)=(200, 110, 80), the backlight luminance for the first area is changed to be (190, 100, 100) and the backlight luminance for the second area is changed to be (200, 110, 90).

The process of correcting the backlight luminance value in this liquid crystal display device (e.g., process of correcting the backlight luminance data shown in FIG. 4 (a) to, e.g., the backlight luminance data shown in FIG. 4(*e*)) can be realized with software. FIG. 7 is a flowchart illustrating algorithm for realizing the above process with software.

In Step S1 of this algorithm, row is set for the number of dividing the display screen vertically into areas, column is set for the number of dividing the display screen horizontally, and diff is set for a tolerance value for a difference between the luminances of the areas. Next, in Step S2, initial values of the backlight for the areas are set. The luminances of the white backlight for the areas are stored in variables W[r,c] (where r falls within a range from 1 to the value indicated by row, and c falls within a range from 1 to the value indicated by column). In the case where the backlight is a color backlight, the luminances of the light sources of the backlight are stored in R[r,c], G[r,c], and B[r,c], not in W. The following explains a process in the case where the backlight is a white backlight. In the case where the backlight is a color backlight, the process is carried out three times for R, G, and B, not for W.

For the process, it is preferable to set at 0 the luminance value of a virtual area assumed to be positioned outside and adjacent to the display screen, but a memory area may be reduced with a method of judging the boundary. For easy understanding, it is assumed herein that the virtually existing adjacent area has a luminance value of 0.

In Step S3 to Step S6, processes corresponding to the processes shown in FIG. 4(*b*) to FIG. 4 (*e*) are carried out respectively. The order of these processes are not limited, but in the example herein, scanning is carried out toward right, then left, then downward, and then upward in the processes. Explanation will be made based on this. First, the variable W[1, 1] of the left end of the first row is compared with a value obtained by subtracting the value indicated by diff from the variable W[1, 0] of a virtual area assumed to be processed just before and positioned left to and next to the left end. A larger one of these values is set as a new value for W[1, 1]. Then, the variable W[1,2] of an area positioned right to and next to the left end is compared with a value obtained by subtracting the value indicated by diff from W[1,1]. A larger one of the values is set as a new value for W[1,2]. Such a process is repeated until the right end of the first row. Thereafter, the process is carried out in the same manner in the second row, third row, up to the last row.

Next, the process is carried out from the right end to the left end one after another in each of all the rows sequentially. Then, the process is carried out in the same manner in the vertical direction from downward to upward, and then from upward to downward. With the scanning thus done for four times, the values of W[r,c] are regarded as the luminance values of the backlight. A difference between the value of W[r,c] of an area and the luminance value of its adjacent area is not more than the tolerance value indicated by diff.

When the value of diff is set at 0 in the processes carried out in Step S3 to Step S6, the same effect is obtained as that in cases where all the backlight areas are handled as one area. Meanwhile, when the value of diff is set at the maximum value in the luminance value range (e.g., 255 in the case of 8 bits), the backlight luminance values after the processes are the same as those before the processes, i.e., the same as the uncorrected backlight luminance values, irrespective of the processes.

As described above, an area, which has a luminance value of 0 at a moment of input of data, may keep the luminance value of 0 after the processes of finding values to be finally used, as long as the transmittance of the liquid crystal is set at 0. However, such a process is omitted in this flowchart. In the case of the backlight provided with the light sources of the three colors R, G, and B, the aforesaid processes make it possible that a difference between luminances of areas respectively corresponding to the colors is a value not more than the value indicated by diff.

Further, by setting diff/2 as diff, the algorithm shown in FIG. 7 is usable without modification to set, at a value not more than the value indicated by diff, a difference between the luminances of areas meeting with their corners in contact, such as areas x[y,z] and x[y−1,z−1].

As described above, in cases where light leaks from one area to another area due to a difference between the areas in the luminance of the backlight, image quality is deteriorated more as the difference in luminance is larger. On the contrary, if the luminances of light from the backlight for the divided areas are rendered less different from each other, electric power consumption is less effectively reduced even by reducing the luminances of light of the backlight. Hence, it is important to actually determine a tolerance luminance value through experiment and simulation in consideration of liquid crystal and a degree of leakage of light between areas.

Thus far, the method of reducing a difference between adjacent areas in luminance to a certain value or less have been explained. However, in some cases, a ratio of the luminances therebetween is significant, rather than the difference in luminance. For example, when the backlight luminance value of one area is 1 and that of its adjacent area is 2, the backlight luminance values are different by 1 in value but are twice different in the ratio. Meanwhile, when the backlight luminance value of one area is 100 and that of its adjacent area is 99, the luminance values are different by 1 in value but are different by 1% in the ratio. Comparing the differences in luminance in the above cases, it is found that the difference in the luminance in the latter case is smaller as compared with that in the former case. As such, in some cases, it is preferable to use a ratio of the luminances of adjacent areas, instead of the absolute value of a difference therebetween. The following explains a method of causing a ratio of the luminance values of adjacent areas to fall within a certain ratio. Specifically, for example, in cases where the difference between the luminances by 10% or greater is not tolerated and the luminance values of the areas are 10 and 8 respectively, the luminance values are different by 20%, so a smaller one of the luminance values, i.e., the luminance value of 8 is increased to 9. Meanwhile, in cases where the luminance values of the areas are 100 and 90, a ratio of the luminance values is 90%, which is in the tolerance range, so no luminance value is changed.

Such a method using a ratio of luminances can be realized in substantially the same way as above. For example, in cases where scanning is carried out from right to left in the flowchart of FIG. 7 and the backlight is a white backlight, the following formula is used:

$$W[r,c]=\max((W[r,(c-1)]-\text{diff}),W[r,c])$$

On the other hand, to adjust the luminances of the adjacent areas in accordance with not the difference therebetween but the ratio thereof, the following formula is used:

$$W[r,c]=\max((W[r,(c-1)]\times\text{diff}),W[r,c])$$

where diff is a parameter indicating a tolerance ratio of the luminances of the adjacent areas. In cases where the ratio thereof is tolerated up to, e.g., 90% as is the case with the above example, 0.9 is set at diff. In cases where the backlight is a color backlight, the same process is carried out for each of R, G, and B, as with the method using the tolerance value of the difference between the luminance values.

Further, by setting square root of diff as diff, the algorithm shown in FIG. 7 is usable without modification to set, at a ratio not more than a ratio corresponding to a value indicated by diff, a ratio of the luminances of areas meeting with their corners in contact, such as areas x[y,z] and x[y−1,z−1]. In this case, when setting the value of diff at 0, the same effect is obtained as that in cases where all the backlight areas are handled as one area. Meanwhile, by setting the value of diff at 1 (100%), the backlight luminance values after the processes are the same as those before the processes, i.e., the same as the uncorrected backlight luminance values, irrespective of the processes.

As with the aforesaid case of securely causing the difference between the luminances of the areas to be equal to or smaller than the luminance difference tolerance value diff, when securely causing the "ratio" to be equal to or smaller than the luminance difference tolerance value diff, it is possible to render the luminance of a certain area 0 as a luminance to be finally used, as long as the luminance of a certain area is originally 0.

The processing functions for comparing luminances in displaying an image are realized by a program. In the present embodiment, the program is stored in a computer-readable storage medium.

In the present embodiment, the storage medium may be a memory necessary for processing carried out by a computer provided in the liquid crystal display device shown in FIG. 2. For example, the storage medium may be a memory which a program can be read out from or be written in, such as the RAM 11, or may be a storage medium, detachably provided in an external storage device of the computer, which stores the program readable via the external storage device. Such an external storage device may be a magnetic tape device, a FD driving device, and a CD-ROM driving device, etc., (not shown). Examples of the storage medium include a magnetic tape, a FD, a CD-ROM, and the like (not shown). In either of the cases, the CPU 12 may be configured to make access to the program stored in each storage medium and run it, or in either of the cases, the program may be read out and loaded from the storage medium to a predetermined program storage area, such as a program storage area of the RAM 11, and then the CPU 12 may read out and run it. A program for loading the programs stored in the storage media is stored in the computer in advance.

In addition, the storage medium is a storage medium arranged so that it can be separated from the computer main body. The storage media hold a program in a fixed manner. Examples of such a storage medium include a tape, such as a magnetic tape and a cassette tape; a magnetic disk, such as a FD (Floppy® disk) and a hard disk; an optical disc, such as a CD-ROM/MO (Magnetic Optical Disc)/MD (Mini Disc)/DVD (Digital Versatile Disc); a card, such as an IC card (inclusive of a memory card)/optical card; and a semiconductor memory, such as a mask ROM, an EPROM (erasable programmable read only memory), an EEPROM (electrically erasable programmable read only memory), or a flash ROM. Alternatively, it is preferable if the storage medium is a storage medium carrying the program in a flowing manner as in the downloading of a program over the communications network. Further, when the program is downloaded over a communications network in this manner, it is preferable if the program for download is stored in the computer main body in advance or installed from another storage medium to the computer main body in advance.

Note that the content of the storage medium is not limited to the program, but may be data.

Note also that the description of embodiments describes a case where the technology disclosed herein is applied to a liquid crystal display; however, the technology disclosed herein is applicable to a general transmissive display in the same way.

Overview of Embodiment

A transmissive display device according to the embodiment of the technology disclosed herein includes: a backlight 17, including a plurality of light emitting areas capable of controlling emitted-light luminances respectively; a liquid crystal panel 20 for controlling transmittances for the light emitted from the backlight 17 for display; an active BL controller 13 for setting emitted-light luminances in the light emitting areas of the backlight 17 respectively; and the active BL controller 13 for setting the transmittances in pixels of the liquid crystal panel 20 in accordance with the emitted-light luminances in the light emitting areas of the backlight 17 respectively, the active BL controller 13 setting the emitted-light luminances such that either a difference between emitted-light luminances in adjacent emitting areas of the backlight 17 or a ratio of the emitted-light luminances in the adjacent light emitting areas is not more than a tolerance value.

According to the above configuration, the active BL controller 13 sets the emitted-light luminances in the light emitting areas of the backlight 17 such that a difference between the emitted-light luminances in adjacent light emitting areas or a ratio of the emitted-light luminances in the adjacent light emitting areas is not more than the tolerance value. This reduces an undesired difference between the luminances of the adjacent areas due to leakage of light, thereby restraining such a problem that a boundary between the areas is viewed and recognized.

The transmissive display device according to the embodiment of the present invention can be configured such that: the active BL controller 13 includes: maximum luminance extracting section 33*a* and 33*b* and maximum luminance storage sections 34*a* and 34*b* for setting each of the emitted-light luminances of the light emitting areas of the backlight 17 at an emitted-light luminance minimally required for display on a pixel with a maximum luminance in the light emitting area; and BL candidate value calculating sections 35*a* and 35*b* for correcting the emitted-light luminances, set by the maximum luminance extracting section 33*a* and 33*b* and maximum luminance storage sections 34*a* and 34*b*, of the light emitting areas such that either the difference between the emitted-light luminances in the adjacent emitting areas or the ratio of the emitted-light luminances in the adjacent light emitting areas is not more than the tolerance value.

The transmissive display device according to the embodiment of the technology disclosed herein can be configured such that: the active BL controller 13 includes: maximum luminance extracting section 33*a* and 33*b* and maximum luminance storage sections 34*a* and 34*b* for setting each of the emitted-light luminances of the light emitting areas of the backlight 17 at an emitted-light luminance minimally required for display on a pixel with a maximum luminance in the light emitting area; and BL candidate value calculating sections 35*a* and 35*b* for correcting the emitted-light luminances, set by the maximum luminance extracting section 33*a* and 33*b* and maximum luminance storage sections 34*a* and 34*b*, of the light emitting areas such that either the difference between the emitted-light luminances in the adjacent emitting areas or the ratio of the emitted-light luminances in the adjacent light emitting areas is not more than the tolerance value.

The transmissive display device according to the embodiment of the technology disclosed herein can be configured such that: among the emitted-light luminances set by the maximum luminance extracting sections 33*a* and 33*b* and the maximum luminance storage sections 34*a* and 34*b*, the BL candidate value calculating sections 35*a* and 35*b* and the BL luminance difference adjusting section 38 extract a light emitting area having an emitted-light luminance whose difference from an emitted-light luminance of an adjacent light emitting area or whose ratio to the emitted-light luminance of the adjacent light emitting area is not less than the tolerance value, and increases the emitted-light luminance of the light emitting area thus extracted, so as to correct the difference between the emitted-light luminances of the adjacent light emitting areas or the ratio of the emitted-light luminances such that the difference or the ratio is not more than the tolerance value.

The transmissive display device according to the embodiment of the technology disclosed herein can be configured such that: to correct the emitted-light luminances, the BL candidate value calculating sections 35*a* and 35*b* and the BL luminance difference adjusting section 38 repeat a correction process of (1) comparing an emitted-light luminance of a target area for correction with either (i) a value obtained by subtracting the tolerance value from an emitted-light luminance of at least one comparative area adjacent to the target area, or (ii) a value obtained by multiplying the tolerance value by the emitted-light luminance of said at least one comparative area, and (2) adopting a maximum value of the compared values as a corrected emitted-light luminance of the target area, the correction process includes a first process of sequentially shifting the target area from left to right in a display screen, a second process of sequentially shifting the target area from right to left in the display screen, a third process of sequentially shifting the target area from upward to downward in the display screen, and a fourth process of sequentially shifting the target area from downward to upward in the display screen, and during each of the first to fourth processes, the comparative area is a light emitting area having been set as a target area earlier than the target area currently being subjected to the correction process.

The transmissive display device according to the embodiment of the technology disclosed herein can be configured such that: the BL candidate calculating sections 35*a* and 35*b* and the BL luminance difference adjusting section 38 maintain a light emitting area having an emitted-light luminance of 0 before correction such that the light emitting area has an emitted-light luminance of 0 after the correction.

According to the above configuration, the light emitting area having an emitted-light luminance of 0 before correction carries out a black display operation, so i is possible to save electric power by maintaining the emitted-light luminance to be 0 after the correction.

The present invention is not limited to the description of the embodiments above, but may be altered by a skilled person within the scope of the claims. An embodiment based on a proper combination of technical means disclosed in different embodiments is encompassed in the technical scope of the present invention.

What is claimed is:

1. A transmissive display device, comprising:

a backlight, including a plurality of light emitting areas capable of controlling emitted-light luminances respectively;

a transmission control panel for controlling transmittances for the light emitted from the backlight for display;

emitted-light luminance setting means for setting emitted-light luminances in the light emitting areas of the backlight respectively; and transmittance setting means for setting the transmittances in pixels of the transmission control panel in accordance with the emitted-light luminances in the light emitting areas of the backlight respectively, the emitted-light luminance setting means:

setting the emitted-light luminances such that either a difference between emitted-light luminances in adjacent emitting areas of the backlight or a ratio of the emitted-light luminances in the adjacent light emitting areas is not more than a tolerance value, including initial emitted-light luminance setting means for setting each of the emitted-light luminances of the light emitting areas of the backlight at an emitted-light luminance minimally required for display on a pixel with a maximum luminance in the light emitting area; and including emitted-light luminance correcting means for correcting the emitted-light luminances, set by the initial emitted-light luminance setting means, of the light emitting areas such that either the difference between the emitted-light luminances in the adjacent emitting areas or the ratio of the emitted-light luminances in the adjacent light emitting areas is not more than the tolerance value.

2. The transmissive display device as set forth in claim 1, wherein:

among the emitted-light luminances set by the initial emitted-light luminance setting means, the emitted-light luminance correcting means extracts a light emitting area having an emitted-light luminance whose difference from an emitted-light luminance of an adjacent light emitting area or whose ratio to the emitted-light luminance of the adjacent light emitting area is not less than the tolerance value, and increases the emitted-light luminance of the light emitting area thus extracted, so as to correct the difference between the emitted-light luminances of the adjacent light emitting areas or the ratio of the emitted-light luminances such that the difference or the ratio is not more than the tolerance value.

3. The transmissive display device as set forth in claim 2, wherein:

to correct the emitted-light luminances, the emitted-light luminance correcting means repeats a correction process of (1) comparing an emitted-light luminance of a target area for correction with either (i) a value obtained by subtracting the tolerance value from an emitted-light luminance of at least one comparative area adjacent to the target area, or (ii) a value obtained by multiplying the tolerance value by the emitted-light luminance of said at least one comparative area, and (2) adopting a maximum value of the compared values as a corrected emitted-light luminance of the target area, the correction process includes a first process of sequentially shifting the target area from left to right in a display screen, a second process of sequentially shifting the target area from right to left in the display screen, a third process of sequentially shifting the target area from upward to downward in the display screen, and a fourth process of sequentially shifting the target area from downward to upward in the display screen, and during each of the first to fourth processes, the comparative area is a light emitting area having been set as a target area earlier than the target area currently being subjected to the correction process.

4. The transmissive display device as set forth in claim 1, wherein:

the emitted-light luminance correcting means maintains a light emitting area having an emitted-light luminance of 0 before correction such that the light emitting area has an emitted-light luminance of 0 after the correction.

5. A display control method for a transmissive display device including a backlight, including a plurality of light emitting areas capable of controlling emitted-light luminances respectively; and a transmission control panel for controlling transmittances for the light emitted from the backlight for display, said display control method, comprising:

an initial emitted-light luminance setting step of setting each of the emitted-light luminances of the light emitting areas of the backlight at an emitted-light luminance minimally required for display on a pixel with a maximum luminance in the light emitting area; and an emitted-light luminance correcting step of correcting the emitted-light luminances, set in the initial emitted-light luminance setting step, of the light emitting areas such that either a difference between emitted-light luminances in adjacent emitting areas or a ratio of the emitted-light luminances in the adjacent light emitting areas is not more than a tolerance value, the emitted-light luminance correcting step being performed to correct the emitted-light luminances by repeating a correction process of (1) comparing an emitted-light luminance of a target area for correction with either (i) a value obtained by subtracting the tolerance value from an emitted-light luminance of at least one comparative area adjacent to the target area, or (ii) a value obtained by multiplying the tolerance value by the emitted-light luminance of said at least one comparative area, and (2) adopting a maximum value of the compared values as a corrected emitted-light luminance of the target area, the correction process including a first process of sequentially shifting the target area from left to right in a display screen, a second process of sequentially shifting the target area from right to left in the display screen, a third process of sequentially shifting the target area from upward to downward in the display screen, and a fourth process of sequentially shifting the target area from downward to upward in the display screen, and during each of the first to fourth processes, the comparative area being a light emitting area having been set as a target area earlier than the target area currently being subjected to the correction process.

6. A computer-readable storage medium storing a display control program for causing a computer to perform the steps of the display control method as set forth in claim 5 for the transmissive display device.

* * * * *